US008203545B2

(12) United States Patent
Imayoshi et al.

(10) Patent No.: US 8,203,545 B2
(45) Date of Patent: Jun. 19, 2012

(54) DISPLAY DRIVING CIRCUIT

(75) Inventors: Takahiro Imayoshi, Tokyo (JP); Tsunetaka Ishimasa, Tokyo (JP)

(73) Assignee: Lapis Semiconductor Co., Ltd. (JP)

( * ) Notice: Subject to any disclaimer, the term of this patent is extended or adjusted under 35 U.S.C. 154(b) by 785 days.

(21) Appl. No.: 11/451,297

(22) Filed: Jun. 13, 2006

(65) Prior Publication Data

US 2006/0284863 A1 Dec. 21, 2006

(30) Foreign Application Priority Data

Jun. 16, 2005 (JP) ..... 2005-176512

(51) Int. Cl.
*G09G 5/00* (2006.01)

(52) U.S. Cl. ..... 345/204; 345/98; 345/100

(58) Field of Classification Search ..... 345/204, 345/98; 326/82
See application file for complete search history.

(56) References Cited

U.S. PATENT DOCUMENTS 5,397,942 A 3/1995 Yamada
5,883,609 A * 3/1999 Asada et al. ..... 345/100
6,437,766 B1 * 8/2002 Matsushima et al. ..... 345/98
6,831,625 B2 * 12/2004 Matsushima et al. ..... 345/98
6,906,706 B2 * 6/2005 Kosaka et al. ..... 345/211
7,042,433 B1 * 5/2006 Kubota et al. ..... 345/100
7,420,534 B2 * 9/2008 Yamashita et al. ..... 345/100
2004/0189579 A1 * 9/2004 Shimizu ..... 345/98
2005/0225500 A1 * 10/2005 Sluyterman ..... 345/22
2005/0264548 A1 * 12/2005 Okamura et al. ..... 345/204

* cited by examiner

*Primary Examiner* — Amare Mengistu
*Assistant Examiner* — Premal Patel
(74) *Attorney, Agent, or Firm* — Studebaker & Brackett PC; Donald R. Studebaker

(57) ABSTRACT

Display data D1 to Dn are latched by a data latch, and are supplied to AND gates which are gate-controlled by a blanking signal/BLK. Output signals from the AND gates are delayed by delay circuits having different time delays of τ1 to τn, and then supplied to drivers. Subsequently, the output signals are supplied to a display device as driving signals Q1 to Qn. The timings of changes of signals S1 to Sn supplied to the drivers are distributed by the delay circuits, so that the timings of currents i1 to in flowing through the drivers are also distributed. Accordingly, a sum Σi of the currents i1 to in changes gradually over time, thereby decreasing the peak current.

9 Claims, 4 Drawing Sheets

Prior Art

DISPLAY DRIVING CIRCUIT

BACKGROUND OF THE INVENTION

1. Field of the Invention

The present invention relates to a display driving circuit for driving a fluorescent display tube, liquid crystal display or the like, and in particular relates to a technique for suppressing peak currents in display driving circuits having a blanking control function.

2. Description of the Related Art

FIG. 2 is a configuration of a conventional driver circuit disclosed in Japanese Patent Kokai No. 5-110266.

This driver circuit drives the lighting of LEDs (Light-Emitting Diodes), fluorescent display tubes or the like. The driver circuit includes a four-bit shift register 1, four-bit data latch 2, four AND (logical product) gates 3, a FF (Flip-Flop) 4, and output terminals Q0 to Q3. The shift register 1 receives a data signal DATA as serial input in synchronization with a clock signal CLK, and then the shift register 1 converts the data into parallel data so that the parallel data are output as four-bit output signals. The data latch 2 captures and outputs the four-bit output signals supplied from the shift register 1 when a latch signal LAT is at "H" level, and continuously outputs the captured signals without modification, even though the latch signal LAT becomes "L" level.

The FF 4 receives a blanking signal BLK in synchronization with the clock signal CLK, and outputs the signal as a control signal CON. The four AND gates 3 respectively calculate the logical products of the four-bit signals output from the data latch 2 and the control signal CON, and output the calculation results from the output terminals Q0 to Q3.

In this driver circuit, the serially-input data signal DATA is captured by the shift register 1 on the rising edge of the clock signal CLK, and is output in parallel from all the bits of the shift register 1. The signals output from the shift register 1 are latched by the data latch 2 during an interval in which the latch signal LAT is "H", and then the signals are supplied to the AND gates 3. On the other hand, the blanking signal BLK is supplied to control output from this driver circuit. The blanking signal BLK, which changes at an arbitrary time independent from the clock signal CLK, is converted at the FF 4 into a control signal CON in synchronization with the clock signal CLK.

When the control signal CON is "L", the AND gates 3 are in the off state, and therefore the output signals from the output terminals Q0 to Q3 are always "L". When the control signal CON is "H", the AND gates 3 are in the on state, and therefore the output signals from the data latch 2 are transmitted to the output terminals Q0 to Q3 through the AND gates 3.

Since the control signal CON is changed in synchronization with the clock signal CLK, change of the output signals from the output terminals Q0 to Q3 is delayed from the timing of the clock signal CLK for a period of time corresponding to the circuit. Accordingly, switching currents flow during the transient state to change the output signals from the output terminals Q0 to Q3, so that even though noise occurs in the signal lines, this noise and the timing of the clock signal CLK do not overlap. Accordingly, it becomes possible to prevent the erroneous operations due to switching current upon changing of the output signals, and to prevent capturing erroneous data signals DATA in the shift register 1 at the rising edge of the clock signal CLK.

In the above-described driver circuit, the output signals of the output terminals Q0 to Q3 are changed simultaneously in response to the change of the control signal CON. Consequently, when the load of the LED, fluorescent display tube or the like connected to the output terminals Q0 to Q3 is large, the switching currents through the load circuits are superposed, so that a peak current from a power supply source during switching becomes extremely large, causing a temporary reduction of the power supply voltage. As a result, there is a possibility of erroneous operation.

SUMMARY OF THE INVENTION

An object of the present invention is to suppress the peak current in a display driving circuit having a blanking control function.

A display driving circuit of this invention includes a plurality of gate circuits for respectively controlling a plurality of display data in response to a blanking signal having a function to temporarily stop displaying the display data. The display data are supplied from a holding circuit. The display driving circuit further includes a plurality of driver circuits for respectively supplying driving signals to drive a display device in response to respective output signals from the gate circuits. The display driving circuit further includes a delay circuit for delaying the driving signals such that periods of delays of the diving signals are sequentially increased from one driving signal to the next, and a minimum period of delay among the driving signals is equal to or longer than a time period of the display data to pass through wiring from output of the holding circuit to output of the driver circuit.

The output signals from the gate circuits, which simultaneously control the output of the display data in response to the blanking signals, are delayed by means of a delay circuit such that period of delays are different from one another. Subsequently, the output signals are supplied to the driver circuit. With this arrangement, the operation timings of the driver circuits are distributed or staggered, and the peak positions of the switching currents of the driver circuits are shifted, so that the sum of the currents flowing through the driver circuits changes gradually over time, thereby reducing the peak current. Hence fluctuations in power supply voltage are suppressed, and a cause of erroneous operation can be eliminated.

The delay circuit provided in this display driving circuit may include an primary inverter stage having a plurality of CMOS inverters connected in parallel and controlled by a control signal so as to invert and output an input signal, and a last inverter stage so as to further invert and output an output signal from the primary inverter stage.

The above-described object and other objects of the invention as well as novel characteristics will become more clear from the following description of the preferred embodiments with reference to the accompanying drawings. The drawings are provided primarily for the purpose of illustration, and do not limit the scope of the invention.

DETAILED DESCRIPTION OF THE INVENTION

First Embodiment

Figure 1:
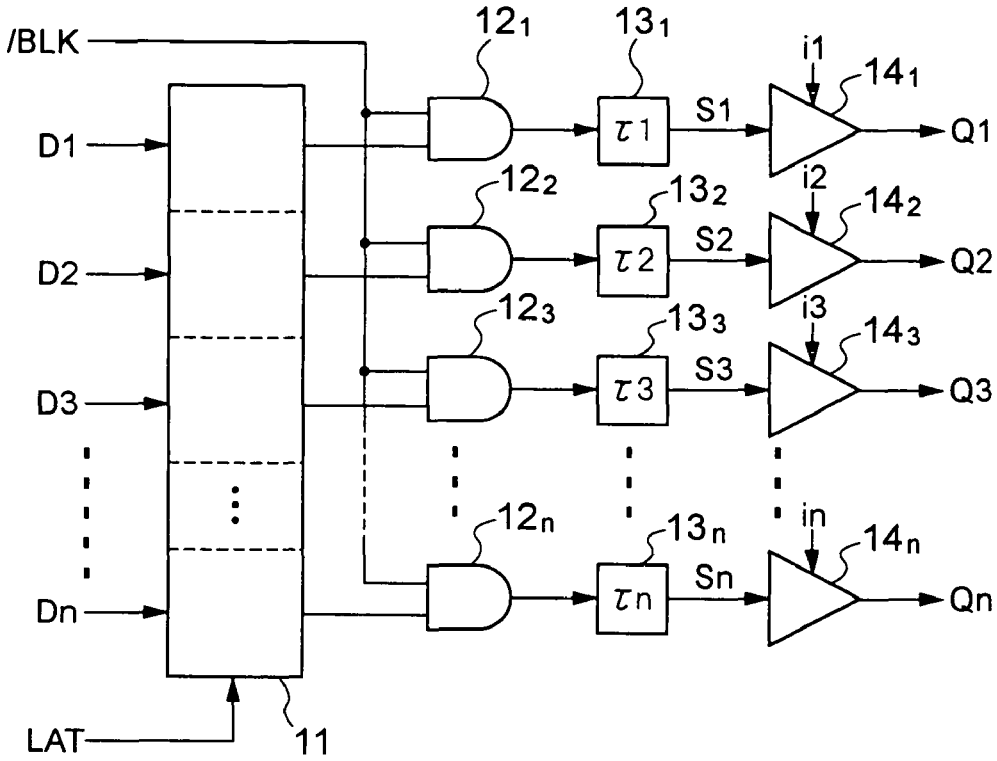
FIG. 1 is a configuration of a display driving circuit showing a first embodiment of the present invention.
Figure 2:
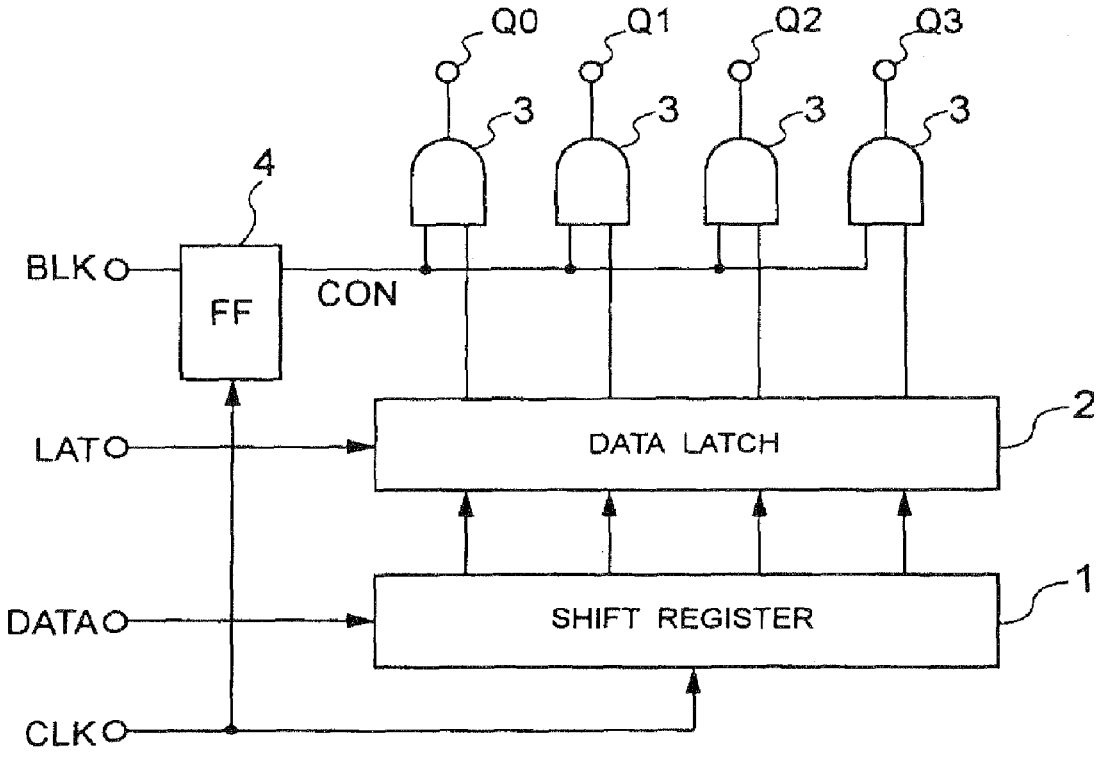
FIG. 2 is a configuration of a conventional driver circuit.

A display driving circuit shown in FIG. 1 drives a fluorescent display tube, liquid crystal display or the like. The display driving circuit has a holding circuit (for example, a data latch) 11 for capturing display data D1, D2, . . . and Dn, which are supplied in parallel, in response to a latch signal LAT. The data latch 11 captures and outputs the display data D1 to Dn in parallel when the latch signal LAT is "H". When the latch signal LAT becomes "L", the data latch 11 continues to output the signals without modification which have been captured during the latch signal LAT being "H".

The outputs of the data latch 11 are respectively connected to AND gates $\mathbf{12}_1$, $\mathbf{12}_2$, . . . and $\mathbf{12}_n$ which are gate-controlled by a common blanking signal /BLK. Specifically, the AND gates $\mathbf{12}_1$ to $\mathbf{12}_n$ always output "L" when the blanking signal /BLK is "L" regardless of the output signal from the data latch 11, whereas the AND gates $\mathbf{12}_1$ to $\mathbf{12}_n$ output the output signals from the data latch 11 without modification when the blanking signal /BLK is "H".

On the output sides of the AND gates $\mathbf{12}_1$ to $\mathbf{12}_n$ are connected delay circuits $\mathbf{13}_1$, $\mathbf{13}_2$, . . . and $\mathbf{13}_n$ respectively having delays of $\tau_1$, $\tau_2$, . . . and $\tau_n$ which are different to one another. In this embodiment, it is assumed that the delays of $\tau_1$ to $\tau_n$ have a relationship of, for example, $\tau_1<\tau_2< \ldots <\tau_n$, and the minimum delay, i.e., $\tau_1$ is greater than a time period (delay) necessary for a signal to pass through the AND gates 12 and wiring therearound.

Signals S1, S2, . . . and Sn output from the delay circuits $\mathbf{13}_1$, $\mathbf{13}_2$, . . . and $\mathbf{13}_n$ are supplied to drivers $\mathbf{14}_1$, $\mathbf{14}_2$, . . . and $\mathbf{14}_n$, respectively. From these drivers $\mathbf{14}_1$ to $\mathbf{14}_n$, driving signals Q1, Q2, . . . and Qn are respectively supplied to a display device (not shown).

Figure 3:
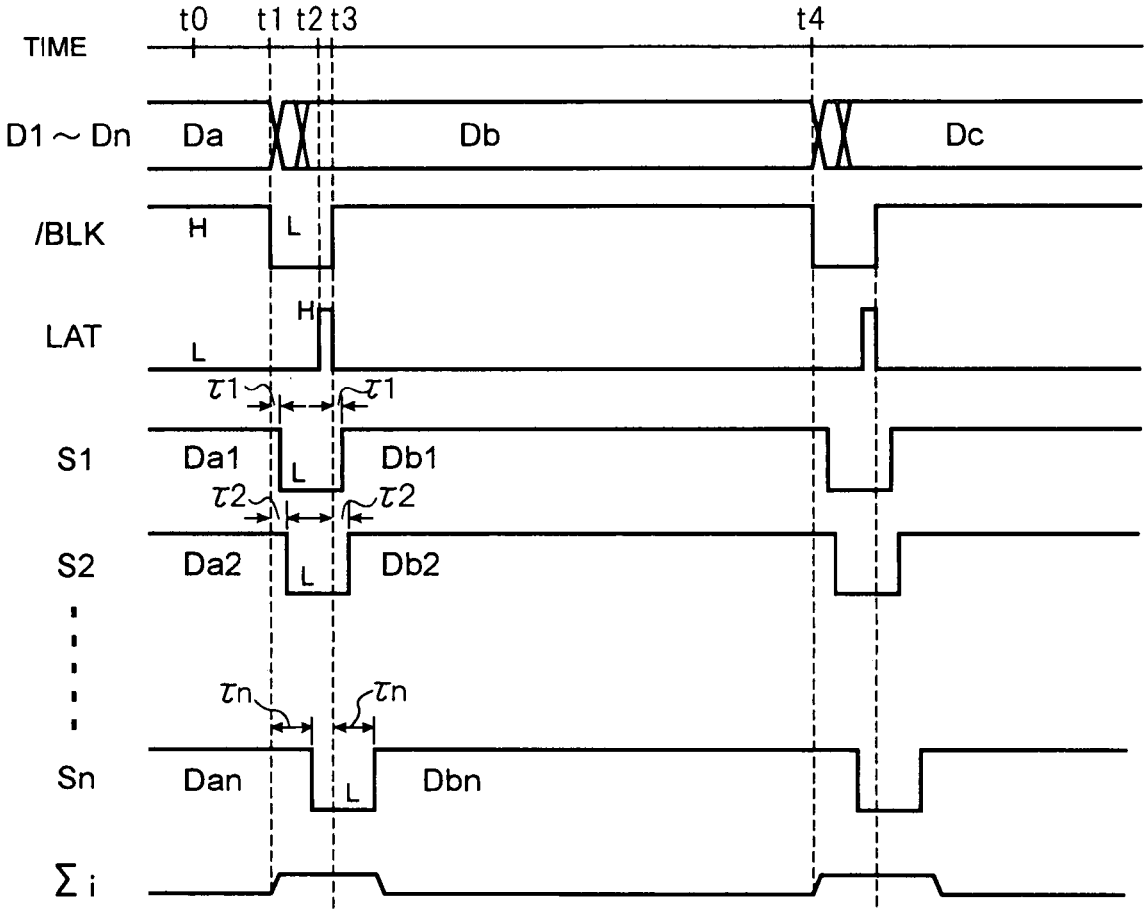
FIG. 3 is a signal waveform chart showing operation of the circuit in FIG. 1.

FIG. 3 is a signal waveform chart showing the operation of the circuit of FIG. 1, which will be hereinafter described.

Suppose that, at time t0 in FIG. 3, n display data Da, i.e., "Da1", "Da2", . . . and "Dan", are held in the data latch 11, the latch signal LAT is "L", the blanking signal /BLK is "H", and delay operation of the delay circuits $\mathbf{13}_1$ to $\mathbf{13}_n$ is stopped. In this state, the AND gates $\mathbf{12}_1$ to $\mathbf{12}_n$ are open, and thus the display data "Da1" to "Dan" output from the data latch 11 are output as the signals S1 to Sn from the delay circuits $\mathbf{13}_1$ to $\mathbf{13}_n$, respectively. The signals S1 to Sn are supplied to the drivers $\mathbf{14}_1$ to $\mathbf{14}_n$, and then supplied to the display device as the driving signals Q1 to Qn.

At time t1, the blanking signal /BLK changes from "H" to "L", and thereafter the display data are switched from Da to Db, i.e., "Db1", "Db2", . . . and "Dbn". At this time, the latch signal LAT remains at "L", and therefore the display data held by the data latch 11 do not change. On the other hand, the AND gates $\mathbf{12}_1$ to $\mathbf{12}_n$ are closed by the blanking signal /BLK, and therefore the signals output from these AND gates $\mathbf{12}_1$ to $\mathbf{12}_n$ are all "L".

The signal S1 output from the delay circuit $\mathbf{13}_1$ becomes "L" after time t1 with a time delay of $\tau\mathbf{1}$. Subsequently, in a similar manner, the signals S2, S3, . . . and Sn output from the delay circuits $\mathbf{13}_2$, $\mathbf{13}_3$, . . . and $\mathbf{13}_n$ sequentially become "L" after time t1 with time delays of $\tau\mathbf{2}$, $\tau\mathbf{3}$, . . . and $\tau$n, respectively.

After the n display data Da supplied to the data latch 11 have completely changed to Db, and the final signal Sn has changed to "L", that is, at time t2, the latch signal LAT turns to "H". As a result, the display data held by the data latch 11 changes from Da to Db. However, at this time the blanking signal /BLK is "L", so that the AND gates $\mathbf{12}_1$ to $\mathbf{12}_n$ remain closed.

At time t3, the blanking signal /BLK turns to "H", and the latch signal LAT becomes "L". As a result, the display data Db output from the data latch 11 are fixed, and the AND gates $\mathbf{12}_1$ to $\mathbf{12}_n$ are opened.

The signal S1 output from the delay circuit $\mathbf{13}_1$ becomes "Db1" after time t3 with the time delay of $\tau\mathbf{1}$. Subsequently, in a similar manner, the signals S2, S3, . . . and Sn output from the delay circuits $\mathbf{13}_2$, $\mathbf{13}_3$, . . . and $\mathbf{13}_n$ sequentially become "Db2", "Db3", . . . and "Dbn" after time t3 with time delays of $\tau\mathbf{2}$, $\tau\mathbf{3}$, . . . and $\tau$n, respectively.

Thereafter, this state persists for a given period, and at time t4 the display data change to Dc, and operation similar to that at time t1 is performed.

It should be noted that the timings to change the signals S1 to Sn, which are respectively supplied to the drivers $\mathbf{14}_1$ to $\mathbf{14}_n$, are distributed by the delay circuits $\mathbf{13}_1$ to $\mathbf{13}_n$ having time delays of $\tau\mathbf{1}$ to $\tau$n which are different from one another. With this arrangement, the peak values of the switching currents of the drivers $\mathbf{14}_1$ to $\mathbf{14}_n$ are respectively shifted by the time delays of $\tau\mathbf{1}$ to $\tau$n. Hence a sum $\Sigma$i of the currents i1 to in flowing in the drivers $\mathbf{14}_1$ to $\mathbf{14}_n$ changes gradually over time, thereby decreasing the peak current.

As described above, the display driving circuit of the first embodiment has the delay circuits $\mathbf{13}_1$ to $\mathbf{13}_n$ which respectively supply the signals S1 to Sn serving display to the drivers $\mathbf{14}_1$ to $\mathbf{14}_n$ at timings different from one another when the display data D1 to Dn, on which the signals S1 to Sn are based, change simultaneously. With this arrangement, the peak current flowing from the power supply source during switching can be distributed or staggered. Accordingly, there is an advantage that the peak current can be suppressed and a temporary drop in the power supply voltage can be alleviated, and erroneous operation can be eliminated.

It should be noted that the present invention is not limited to the configuration described above, and various modifications may be made. The following are examples of such modifications.

(1) In place of the AND gates $\mathbf{12}_1$ to $\mathbf{12}_n$, NOR gates or other logic gates can be used.

(2) The time delay of $\tau\mathbf{1}$ of the delay circuit $\mathbf{13}_1$ may be zero. That is, the delay circuit $\mathbf{13}_1$ can be omitted.

(3) It is not necessary that the time delays of $\tau\mathbf{1}$ to $\tau$n of the delay circuits $\mathbf{13}_1$ to $\mathbf{13}_n$ have the relationship of $\tau\mathbf{1}<\tau\mathbf{2}< \ldots <\tau$n. It is sufficient that the timings be shifted such that the drivers $\mathbf{14}_1$ to $\mathbf{14}_n$ do not simultaneously perform switching operations.

(4) The time delays of $\tau\mathbf{1}$ to $\tau$n need not be all different values. It is sufficient that the switching currents of the drivers $\mathbf{14}_1$ to $\mathbf{14}_n$ be distributed so as not to cause erroneous operation.

Second Embodiment

Figure 4:
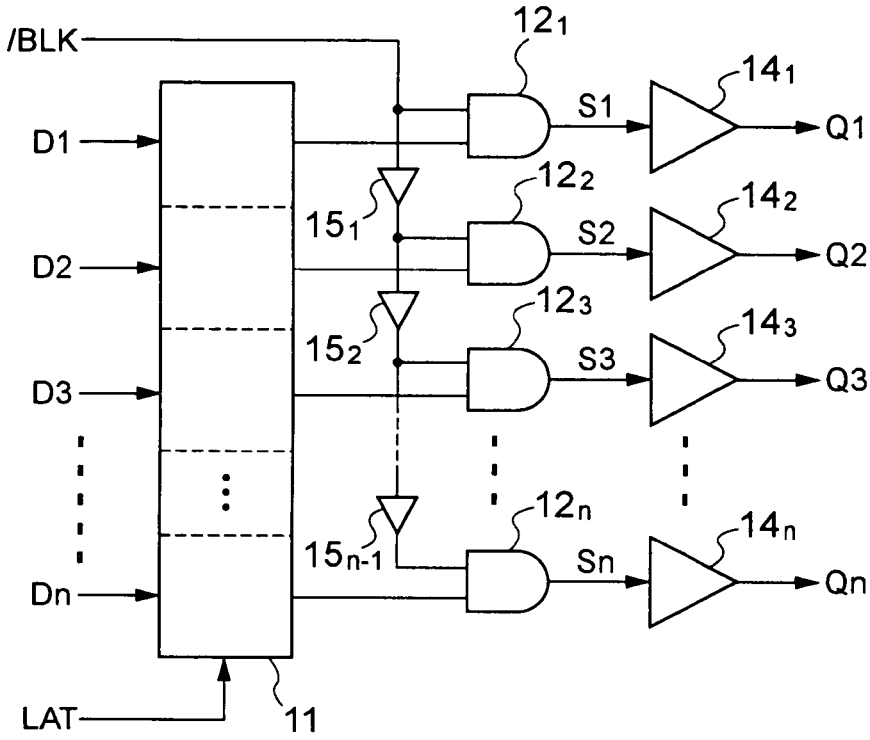
FIG. 4 is a configuration of a display driving circuit showing a second embodiment of the present invention; and, FIG. 5 is a configuration of a delay buffer showing a third embodiment of the present invention.

FIG. 4 is a configuration of a display driving circuit according to a second embodiment of the present invention. The same reference numerals are assigned for the same elements as in FIG. 1.

In this display driving circuit, the delay circuits $\mathbf{13}_1$ to $\mathbf{13}_n$ of FIG. 1 are deleted, and the drivers $\mathbf{14}_1$ to $\mathbf{14}_n$ are connected to the output sides of the AND gates $\mathbf{12}_1$ to $\mathbf{12}_n$. In addition, the blanking signal /BLK is supplied to these AND gates $\mathbf{12}_1$ to $\mathbf{12}_n$ after respective time delays by means of a delay circuit. The delay circuit consists of delay buffers $\mathbf{15}_1$, $\mathbf{15}_2$, . . . and $\mathbf{15}_{n-1}$ having the same circuit configurations and connected in series. Specifically, the blanking signal /BLK is supplied to the AND gate $\mathbf{12}_1$. The blanking signal/BLK is supplied to the AND gate $\mathbf{12}_2$ via the delay buffer $\mathbf{15}_1$ providing a delay of $\tau$. The blanking signal /BLK is supplied to the AND gate $\mathbf{12}_3$ via the delay buffers $\mathbf{15}_1$ and $\mathbf{15}_2$ providing a delay of $2\tau$. Subsequently, a blanking signal is supplied in a similar manner, and the blanking signal /BLK is supplied to the final AND gate $12_n$ via the delay buffers $15_1$ to $15_{n-1}$ providing a delay of (n−1)τ. Other configurations are similar to those of FIG. 1.

The operation of this display driving circuit is substantially similar to that of FIG. 1.

When the display data D1 to Dn do not change, the latch signal LAT is "L" and the blanking signal /BLK is "H", the output signals from the delay buffers $15_1$ to $15_{n-1}$ are all "H", and the AND gates $12_1$ to $12_n$ are open. Hence the display data D1 to Dn output from the data latch 11 are output as the signals S1 to Sn via the AND gates $12_1$ to $12_n$, respectively. The signals S1 to Sn are supplied to the drivers $14_1$ to $14_n$, and then driving signals Q1 to Qn are supplied to the display device.

In order to change the display data D1 to Dn, the blanking signal /BLK initially changes from "H" to "L". Thereafter, the display data D1 to Dn begin to change. However, at this time the latch signal LAT remains at "L", so that the display data held by the data latch 11 do not change. On the other hand, changing of the blanking signal /BLK to "L" closes the AND gate 121, and the signal S1 output from this AND gate $12_1$ becomes "L".

When the blanking signal /BLK changes to "L", the output signal from the delay buffer $15_1$ changes to "L" with a time delay of τ. As a result, the signal S2 output from the AND gate $12_2$ turns to "L". In a similar manner, at subsequent elapses of time intervals each having a period of τ, output signals from the delay buffers $15_2$, $15_3$, . . . and $15_{n-1}$ respectively turn to "L". Consequently, after a time period of (n−1)τ, all the signals S3 to Sn output from the AND gates $12_3$ to $12_n$ become "L".

When all the display data D1 to Dn supplied to the data latch 11 have changed, and the final signal Sn has turned to "L", the latch signal LAT turns to "H". As a result, the display data D1 to Dn held by the data latch 11 change. However, at this time the blanking signal /BLK is "L", and therefore the AND gates $12_1$ to $12_n$ remain closed.

Next, the blanking signal /BLK turns to "H", and the latch signal LAT turns to "L". As a result, the display data D1 to Dn output from the data latch 11 are fixed, and the AND gate $12_1$ is opened. A signal S1 corresponding to the display data D1 after the change is output from the AND gate $12_1$, and is supplied to the driver $14_1$.

After the blanking signal /BLK turns to "H", the output signal from the delay buffer $15_1$ changes to "H" with a time delay of τ. As a result, a signal S2 corresponding to the display data D2 after the change is output from the AND gate $12_2$. In a similar manner, at subsequent elapses of time intervals each having a period of τ, output signals from the delay buffers $15_2$, $15_3$, . . . and $15_{n-1}$ respectively turn to "H". As a result, signals S3 to Sn corresponding to display data after the change are subsequently output from the AND gates $12_3$ to $12_n$.

The timings of the changes of the signals S1 to Sn supplied to the drivers $14_1$ to $14_n$ are distributed by a delay time τ by means of the delay buffers $15_1$ to $15_n$. Consequently, the peak positions of the switching currents of the drivers $14_1$ to $14_n$ are distributed, and the sum Σi of the currents i1 to in flowing in the drivers $14_1$ to $14_n$ changes gradually over time, thereby decreasing the peak current.

As described above, the display driving circuit of the second embodiment has the delay buffers $12_1$ to $12_{n-1}$ which respectively supply the signals S1 to Sn serving display to the drivers $14_1$ to $14_n$ at timings different from one another when the display data D1 to Dn, on which the signals S1 to Sn are based, changes simultaneously. Consequently, the advantage similar to that of the first embodiment is obtained. The delay buffers $12_1$ to $12_{n-1}$ have the same delays, and therefore there is an advantage that design is easier than the delay circuits $13_1$ to $13_n$ of the first embodiment having different time delays.

This invention is not limited to the configuration described above, and various modifications may be made. The following is an example of such a modification.

(1) The delay buffers 15 are not limited to the configuration in the above-described description where the delay buffers 15 are respectively provided for the drivers $14_1$ to $14_n$. The delay buffers 15 may be provided for every two outputs or for every three outputs on condition that the peak of the switching current is low.

Third Embodiment

Figure 5:
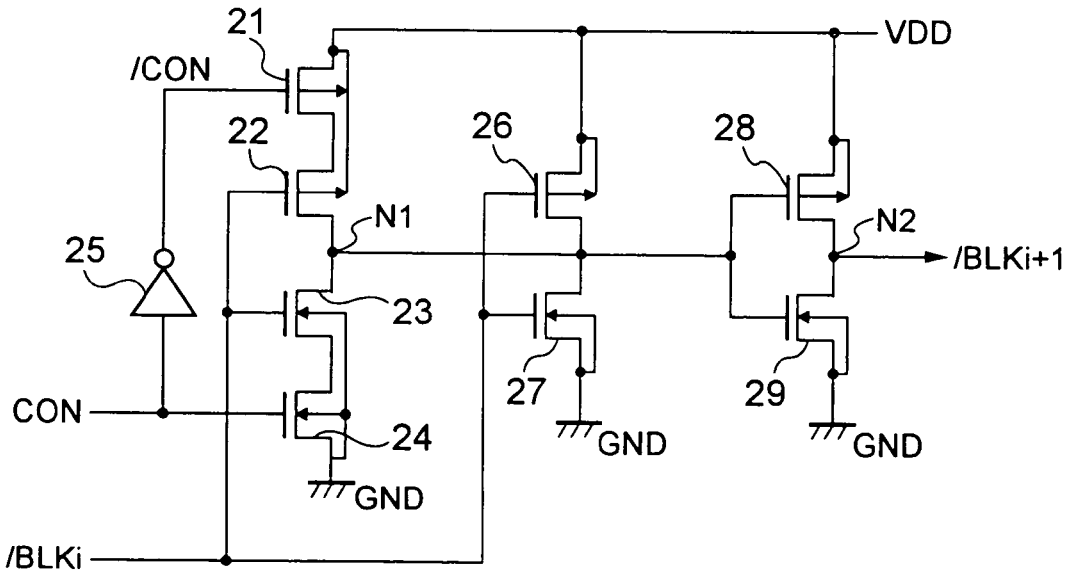

FIG. 5 is a configuration of a delay buffer according to a third embodiment of the present invention.

This delay buffer is provided in place of each of the delay buffers $15_1$ to $15_{n-1}$ of FIG. 4. It should be noted that one delay buffer $15_1$ ($1 \leqq i \leqq n-1$) is shown in FIG. 5. Basically the delay buffer has a primary inverter stage and last inverter stage connected in series. The primary inverter stage is configured with two inverters connected in parallel, such that a control signal is used to electrically disconnect one of the inverters so as to control the time delay.

Specifically, the primary inverter stage includes a first CMOS inverter. The first CMOS inverter has PMOS (P channel MOS) transistors 21 and 22 connected in series between the power supply potential VDD and a node N1 and NMOS (N channel MOS) transistors 23 and 24 connected in series between this node N1 and the ground potential GND. The control signal CON and the control signal /CON, which is an inversion of the control signal CON by an inverter 25, are respectively supplied to the gates of the switching NMOS transistor 24 and PMOS transistor 21. The delay signal /BLKi is supplied to the gates of the PMOS transistor 22 and NMOS transistor 23.

The primary inverter stage further includes a second inverter arranged in parallel with the first CMOS inverter, and the second inverter has a PMOS transistor 26 and NMOS transistor 27. The source of the PMOS transistor 26 is connected to the power supply potential VDD, and the drain thereof is connected to the node N1. The drain of the NMOS transistor 27 is connected to the node N1, and the source thereof is connected to the ground potential GND. The blanking signal /BLKi is supplied to the gates of the PMOS transistor 26 and NMOS transistor 27.

On the other hand, the last inverter stage has a PMOS transistor 28 and NMOS transistor 29 which are connected to the primary inverter stage via the node N1. The source of the PMOS transistor 28 is connected to the power supply potential VDD, and the drain thereof is connected to a node N2. The drain of the NMOS transistor 29 is connected to the node N2, and the source thereof is connected to the ground potential GND. The gates of the PMOS transistor 28 and NMOS transistor 29 are connected to the node N1, which is the output of the primary inverter stage. The blanking signal/BLKi+1 is output from the node N2.

In this delay buffer, when the control signal CON is "L", the PMOS transistor 21 and NMOS transistor 24 are in the off state, and the first inverter is cut off from the power supply potential VDD and ground potential GND. As a result, the blanking signal /BLKi is inverted by the second inverter, and again inverted by the last inverter stage, and then output as the blanking signal /BLKi+1. The time delay in this case is the sum of the time delays of the second inverter and the last inverter stage.

When the control signal CON is "H", the PMOS transistor 21 and NMOS transistor 24 are in the on state, and the first inverter is connected in parallel with the second inverter. As a result, driving performance of the primary inverter stage connected in parallel is improved, thereby decreasing the sum of the time delays.

As described above, the delay buffer of the third embodiment can control the time delay through the delay signal CON, so that by replacing the delay buffer 15 in FIG. 4 with this delay buffer, there is an advantage that the time delay can be dynamically controlled during circuit operation.

This invention is not limited to the configuration described above, and various modifications are possible. The following is an example of such a modification.

(1) The control signal CON is not limited to the configuration shown in the above description where the control signal CON controls only the operation of the first inverter. By providing a plurality of inverters in parallel with the second inverter, the operation of such inverters may be respectively controlled by a plurality of control signals, which makes it possible to select desired time delay from among a plurality of time delays.

This application is based on a Japanese patent application No. 2005-176512 which is herein incorporated by reference.

What is claimed is:

1. A display driving circuit comprising:

a plurality of gate circuits arranged to respectively control a plurality of display data in response to a blanking having a function to temporarily stop displaying the display data, said display data being supplied from a holding circuit;

a plurality of driver circuits connected to said plurality of gate circuits respectively to receive respective output signals from said plurality of gate circuits and to respectively supply driving signals to drive a display device in response to the respective output signals from said plurality of gate circuits, the plurality of driver circuits receiving a plurality of switching currents respectively to operate; and a plurality of delay circuits provided between said gate circuits and said driver circuits respectively and arranged to delay said driving signals such that periods of delays of said driving signals are sequentially increased from one driving signal to the next, whereby timing of a peak current flowing to one of the driver circuits is shifted from timing of a peak current flowing to the next one of the driver circuits, and a minimum period of delay among said driving signals, which are caused by the plurality of delay circuits, is equal to or longer than a time period of the display data to pass through wiring from output of said holding circuit to output of any of said driver circuits.

2. The display driving circuit according to claim 1, wherein said plurality of delay circuits have a plurality of time delays respectively corresponding to said driving signals.

3. The display driving circuit according to claim 1, wherein said delay circuits are provided before said gate circuits, respectively.

4. The display driving circuit according to claim 1, wherein said driving signals have different time delays from each other.

5. The display driving circuit according to claim 1, wherein said delay circuits include an primary inverter stage having a plurality of CMOS inverters connected in parallel and controlled by a control signal so as to invert and output an input signal, and a last inverter stage so as to further invert and output an output signal from said primary inverter stage.

6. The display driving circuit according to claim 1, wherein said delay circuits include a plurality of delay buffers respectively corresponding to the display data.

7. The display driving circuit according to claim 6, wherein the delay buffers are respectively provided between the gate circuits and the driver circuits.

8. The display driving circuit according to claim 6, wherein the delay buffers are respectively provided before the gate circuits.

9. The display driving circuit according to claim 6, wherein the delay buffers have the same configuration.

* * * * *